US009205686B2

(12) United States Patent
Kita et al.

(10) Patent No.: US 9,205,686 B2
(45) Date of Patent: Dec. 8, 2015

(54) PRINTER

(71) Applicants: Hiroaki Kita, Nagoya (JP); Minoru Yamamoto, Nagoya (JP)

(72) Inventors: Hiroaki Kita, Nagoya (JP); Minoru Yamamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 462 days.

(21) Appl. No.: 13/625,311

(22) Filed: Sep. 24, 2012

(65) Prior Publication Data

US 2013/0105617 A1 May 2, 2013

(30) Foreign Application Priority Data

Oct. 31, 2011 (JP) ..... 2011-239576

(51) Int. Cl.
*B41J 15/04* (2006.01)
*B65H 16/06* (2006.01)

(52) U.S. Cl.
CPC ..... *B41J 15/042* (2013.01); *B65H 16/06* (2013.01)

(58) Field of Classification Search
USPC ..... 242/596, 596.4, 596.5, 596.6, 578, 242/578.1
See application file for complete search history.

(56) References Cited

U.S. PATENT DOCUMENTS

| | | | | |
|---|---|---|---|---|
| 5,587,044 | A * | 12/1996 | Goto | 156/577 |
| 6,099,179 | A * | 8/2000 | Higashi et al. | 400/613 |
| 6,347,897 | B2 * | 2/2002 | Huggins et al. | 400/621 |
| 6,695,500 | B2 * | 2/2004 | Kim et al. | 400/613 |
| 7,284,725 | B2 * | 10/2007 | Inana | 242/578.2 |
| 7,802,750 | B2 * | 9/2010 | Takeuchi | 242/596.4 |
| 7,909,522 | B2 * | 3/2011 | Heaton et al. | 400/88 |
| 2002/0121566 | A1 * | 9/2002 | Fiutak et al. | 242/348 |
| 2004/0211853 | A1 * | 10/2004 | Inana et al. | 242/348 |
| 2011/0215189 | A1 * | 9/2011 | Asai | 242/596.4 |

FOREIGN PATENT DOCUMENTS

| | | |
|---|---|---|
| CN | 2615707 | 5/2004 |
| CN | 1911671 | 2/2007 |
| CN | 1931594 | 3/2007 |
| JP | 4-71874 A | 3/1992 |
| JP | 6-72597 A | 3/1994 |
| JP | H09-234922 | 9/1997 |
| JP | 2009-173353 A | 8/2009 |
| JP | 2011-31487 | 2/2011 |
| JP | 2011-177897 | 9/2011 |

OTHER PUBLICATIONS

Office Action issued in Chinese Application No. 201210352877.8 on Sep. 19, 2014.

* cited by examiner

*Primary Examiner* — Emmanuel M Marcelo
*Assistant Examiner* — Justin Stefanon
(74) *Attorney, Agent, or Firm* — McCarter & English, LLP

(57) ABSTRACT

A printer includes a first case and a second case, a paper containing portion is formed in the first case and contains a paper roll, a paper holder is provided in the paper containing portion and hold the paper roll, a pair of supporting members are provided in the paper holder and hold both ends of the paper roll, with each of the supporting members holding one of the ends, a contacting portion is provided in the paper holder and is thicker than are the supporting members, and a first projection projects in the paper containing portion from the first case toward the paper holder and is positioned, in the axial direction of the paper roll, between the contacting portion and a wall surface of the first case located on the side of the contact portion and is able to come into contact with the contacting portion.

12 Claims, 9 Drawing Sheets

PRINTER

CROSS-REFERENCE TO RELATED APPLICATION

This application claims priority from JP2011-239576, filed on Oct. 31, 2011, the content of which is hereby incorporated by reference.

BACKGROUND

The present disclosure relates to a printer and specifically relates to a printer that can contain a roll of paper.

A portable printer is known that contains a roll of paper as a printing medium in a paper containing portion inside a housing. In the printer, a cover that can be opened and closed is provided in the paper containing portion, and by opening the cover, a user can replace the roll of paper in a paper holder that is provided inside the paper containing portion. A left-right pair of supporting members (roll guides) that can be moved in accordance with the width of the roll of paper are provided in the paper holder. The roll of paper is held by its left and right ends being held by the pair of the supporting members. A rack gear that is parallel to the axial direction of the roll of paper is affixed to each of the supporting members, and the two rack gears engage with a single pinion gear. Therefore, when one of the supporting members is moved a given distance, the other supporting member is moved the same distance in the opposite direction.

SUMMARY

However, when an operator carries and uses the printer, cases occur in which the printer is dropped and strikes the ground, and cases occur in which the printer is struck against a fixed object. In those sorts of cases, a problem occurs in that, when an impact is applied to the printer, the paper holder and the supporting members may be damaged due to the weight of the roll of paper.

It is one object of the present disclosure to provide a printer in which damage to the paper holder and the supporting members can be prevented, even in a case where an impact is applied to the printer.

In order to achieve the object described above, in a first aspect of this disclosure, a printer includes a first case, a second case, a paper containing portion, a paper holder, a pair of supporting members, a contacting portion, and a first projection. The first case and the second case configure a housing. The paper containing portion is formed in the first case and is configured to contain a paper roll around which a printing paper is wound. The paper holder is provided in the paper containing portion and is configured to hold the paper roll. The pair of the supporting members are provided in the paper holder and are configured to hold both ends of the paper roll, with each of the supporting members holding one of the ends. The contacting portion is provided in the paper holder and is thicker in the axial direction of the paper roll than are the supporting members. The first projection projects in the paper containing portion from the first case toward the paper holder and is positioned, in the axial direction of the paper roll, which is orthogonal to the direction in which the printing paper is pulled off of the paper roll, between the contacting portion and a wall surface of the first case that is located on the side of the contact portion. The first projection is able to come into contact with the contacting portion.

In order to achieve the object described above, in a second aspect of this disclosure, a printer includes a first case, a second case, a paper containing portion, a paper holder, a pair of supporting members, a first projection, and a contacting portion. The first case and the second case configure a housing. The paper containing portion is formed in the first case and is configured to contain a paper roll around which a printing paper is wound. The paper holder is provided in the paper containing portion and is configured to hold the paper roll. The pair of the supporting members are provided in the paper holder and are configured to hold both ends of the paper roll, with each of the supporting members holding one of the ends. The first projection projects in the paper containing portion from the first case toward the paper holder. The contacting portion is provided in the paper holder, being provided such that it is separated from the first projection by a specified distance in the axial direction of the paper roll, which is orthogonal to the direction in which the printing paper is pulled off of the paper roll. The contacting portion is thicker in the axial direction of the paper roll than are the supporting members and is able to come into contact with the first projection.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Figure 1:
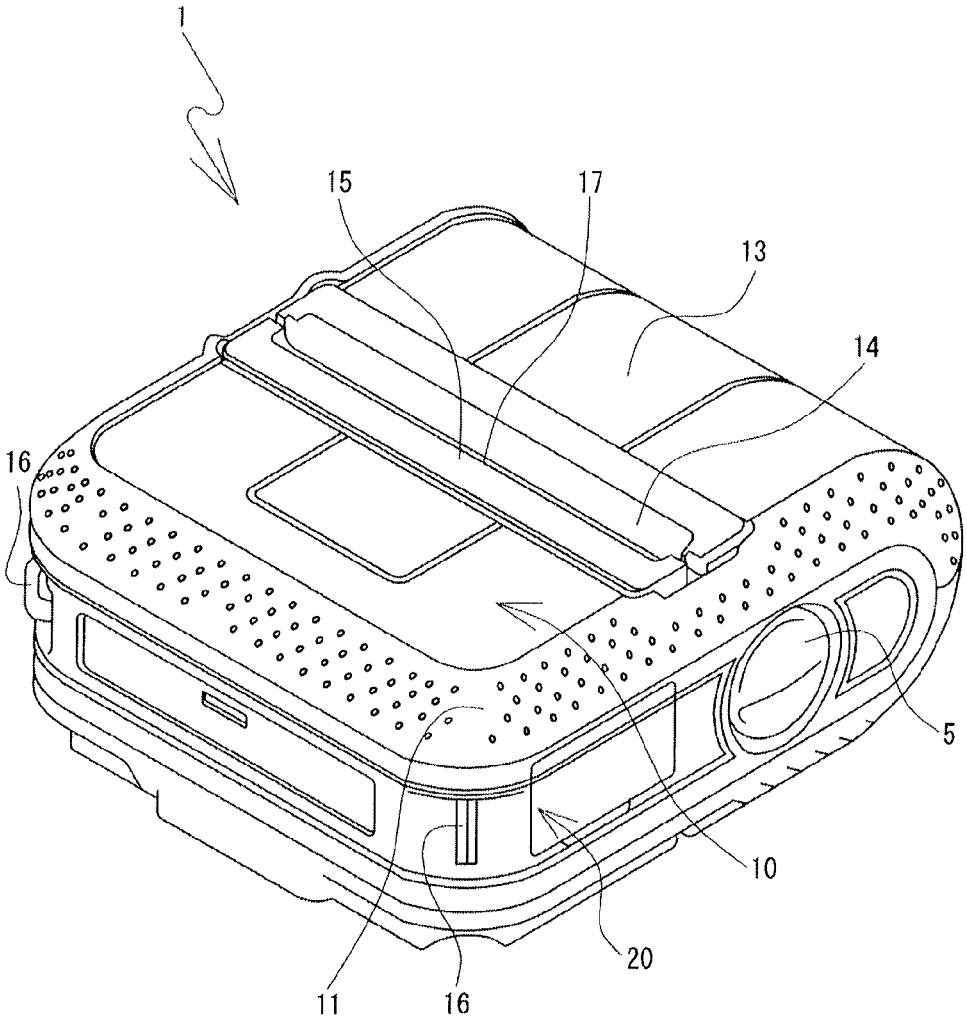
FIG. 1 is a perspective view that shows an exterior structure of a printer 1 that is an embodiment of the present disclosure.

Hereinafter, a structure of a portable printer 1 that is an embodiment of a printer according to the present disclosure will be explained with reference to the drawings. The lower right, the upper left, the upper right, the lower left, the front surface of the page, and the rear surface of the page in FIG. 1 are respectively defined as the right side, the left side, the rear side, the front side, the top side, and the bottom side of the printer 1.

Figure 2:
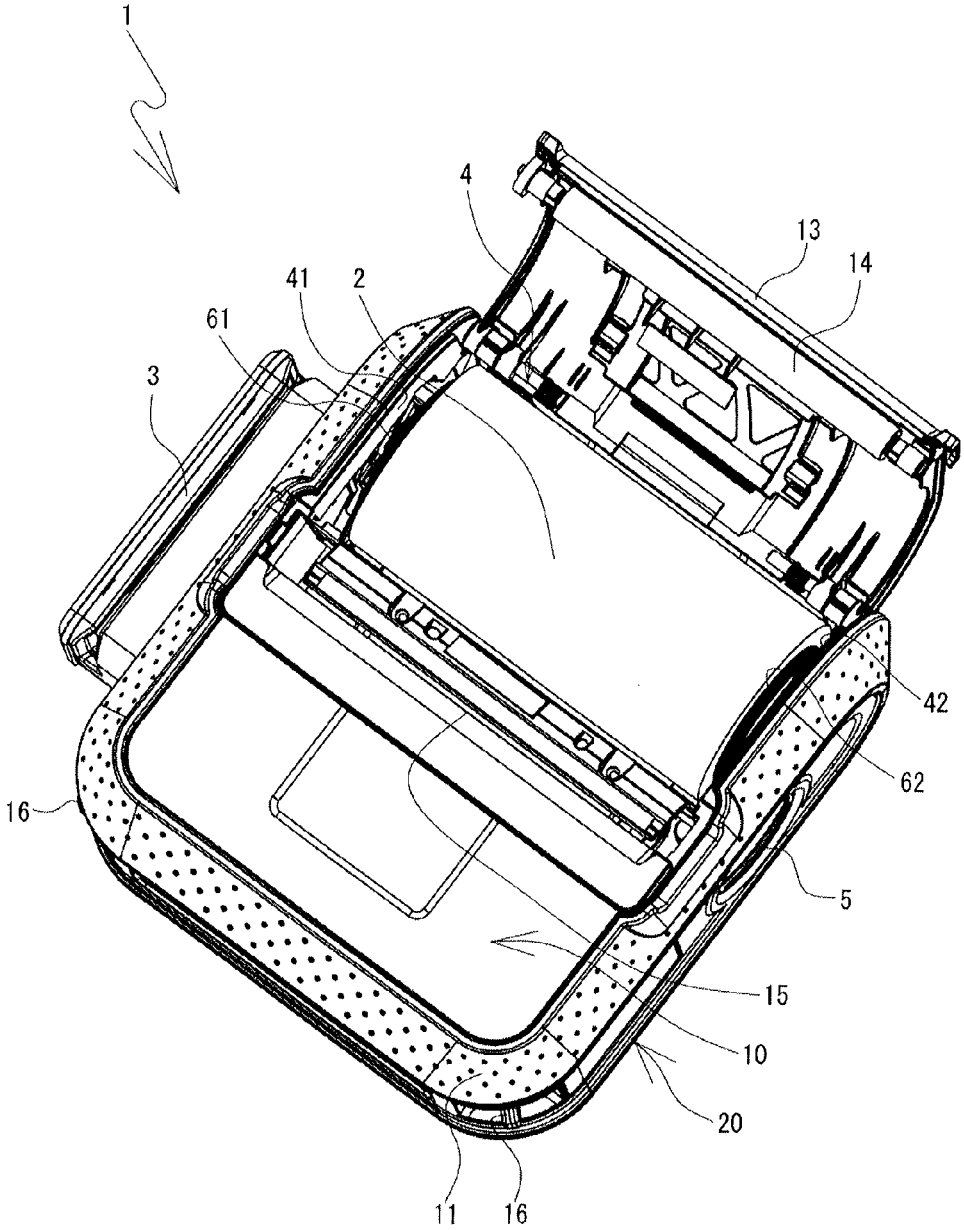
FIG. 2 is a perspective view of the printer 1 with a lid 13 open.

The printer 1 is a printer that takes printing data that have been received from an external device (not shown in the drawings), such as a PC terminal, a mobile telephone, or the like, for example, and prints the content that is described by the printing data on heat-sensitive printing paper that is pulled off of a paper roll 2 around which it is wound. As shown in FIGS. 1 and 2, the printer 1 is provided with a substantially box-shaped housing in which a top case 10 and a bottom case 20 are fitted together. The top case 10 and the bottom case 20 may be made of a resin material, for example. The printer 1 contains a battery in its interior and can be powered by the battery. The bottom case 20 is formed in an approximately rectangular shape in a plan view, a left-right pair of insertion portions 16, 16 are provided in the two corners of front edge of the bottom case 20. By inserting a strap or the like into the insertion portions 16, 16, an operator can hang the printer 1 from his shoulder or neck, from a belt around his waist, or the like. The operator can carry the battery-powered printer 1 to various locations and use it in those locations. An opening-closing member 5 is provided on the right side face of the bottom case 20. The opening-closing member 5 is a rotating knob for releasing a lock on a lid 13 (described later). As shown in FIG. 2, a card reader 3 that reads a magnetic card is provided on the left side face of the bottom case 20.

Figure 3:
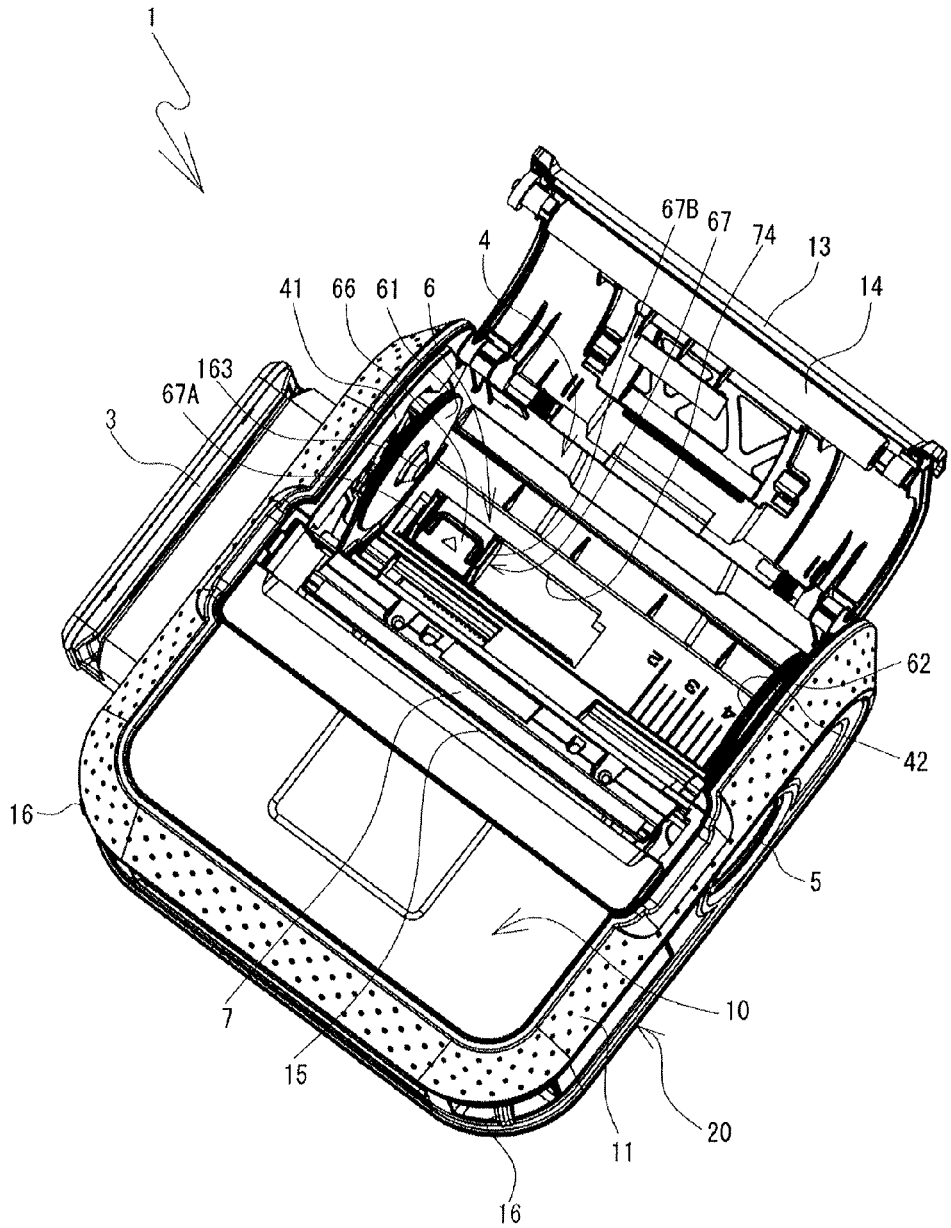
FIG. 3 is a perspective view of the printer 1 in a state in which a paper roll 2 has been removed.

Next, the structure of the top case 10 will be explained. As shown in FIG. 1, the top case 10 is formed in an approximately rectangular shape in a plan view. A discharge outlet 17 that is a slit from which the paper is discharged after printing is provided in a central portion of the top case 10. A protector 11 that is made of an impact-absorbing material such as rubber or the like is provided around the outer circumference of the upper portion of the top case 10. The lid 13, which can be opened and closed, is provided in the top case 10 to the rear of the discharge outlet 17. A cylindrical platen roller 14 is provided at the front edge of the lid 13. The rear edge of the lid 13 is axially supported by the bottom case 20 such that the lid 13 can rotate about the axis. In a central portion of the top case 10, a fixed edge 15 is provided that extends along the length of the discharge outlet 17 in a position that is opposite the platen roller 14. As shown in FIG. 3, a thermal head 7 that performs printing by applying heat to the printing paper is provided obliquely below the fixed edge 15 such that it is parallel to the platen roller 14. An electronic circuit board that controls the printer 1, as well as the battery and the like (not shown in the drawings), are contained inside the top case 10, toward the front from the fixed edge 15.

As shown in FIG. 3, a paper containing portion 4 is formed underneath the lid 13 of the top case 10. A paper holder 6 is affixed to the paper containing portion 4. In the paper holder 6, each end of the paper roll 2 (refer to FIG. 2) is held by one of supporting members 61, 62 such that the paper roll 2 can rotate. The paper roll 2 can be mounted on and detached from the supporting members 61, 62. An upper left inner wall surface 41 that is a flat surface is formed at the upper left edge of the paper containing portion 4, and an upper right inner wall surface 42 that is a flat surface is formed at the upper right edge of the paper containing portion 4.

Figure 4:
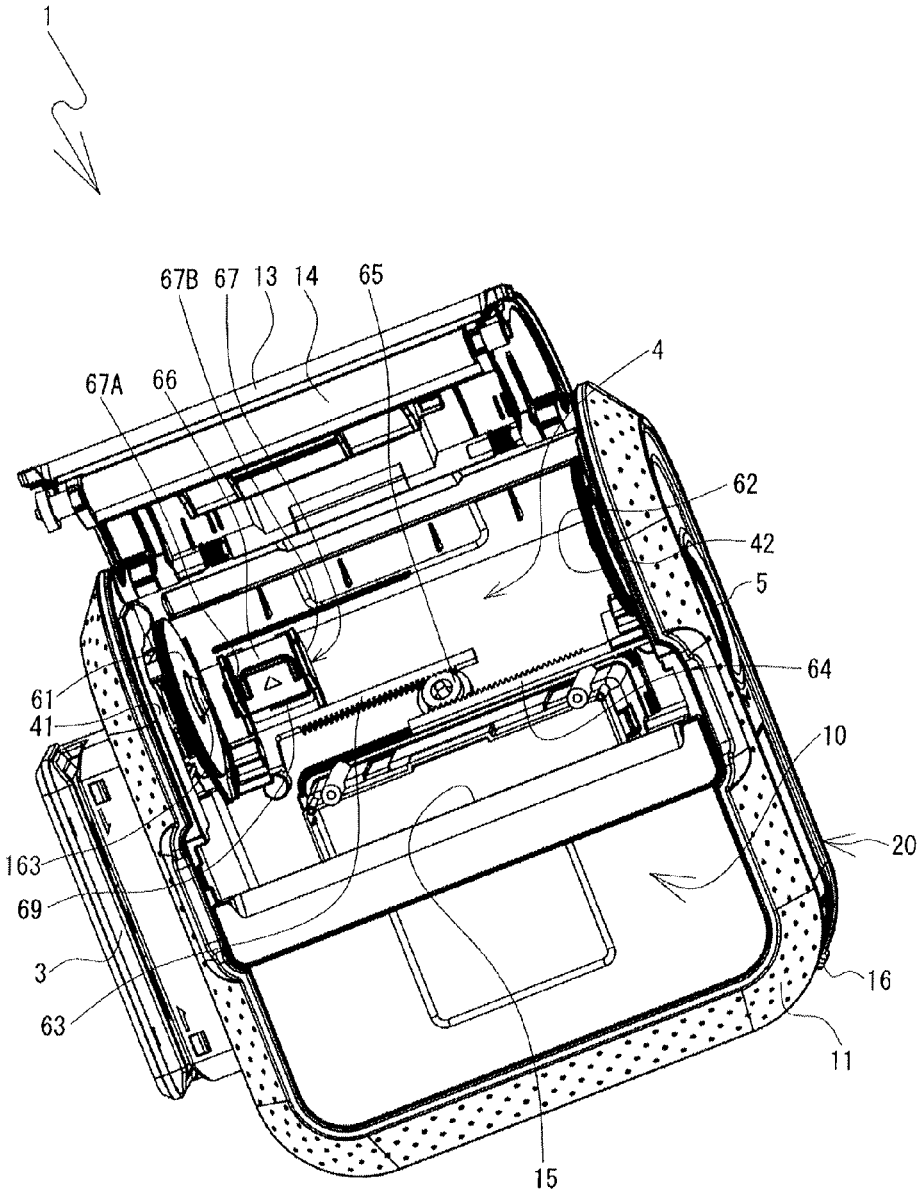
FIG. 4 is a perspective view that shows meshing of a pinion gear 65 and rack gears 63, 64 in a paper containing portion 4 with a holder frame 70 removed.
Figure 5:
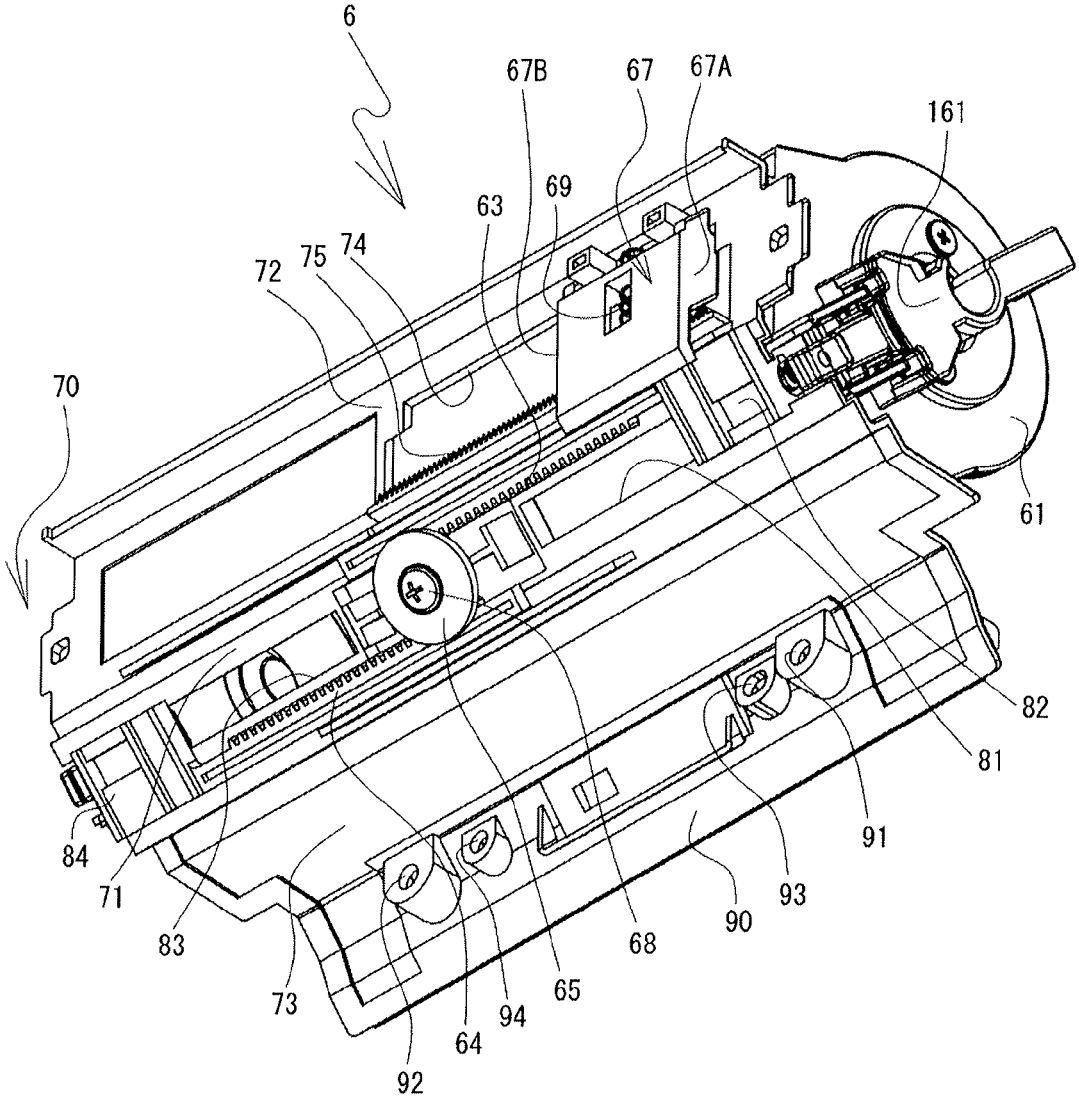
FIG. 5 is a perspective view of a paper holder 6 as seen from below.

The structure of the paper holder 6 will be explained with reference to FIGS. 4 to 6. As shown in FIG. 5, the paper holder 6 is provided with a holder frame 70 in its lower portion. The holder frame 70 is configured from a center frame 71, a rear frame 72, and a front frame 73. The center frame 71 is approximately rectangular. The rear frame 72 is approximately rectangular and extends obliquely toward the rear from the center frame 71. The front frame 73 is approximately rectangular and extends obliquely toward the front from the center frame 71. Screw holes 91, 92, 93, 94 are formed in the front frame 73. The holder frame 70 is affixed to the bottom case 20 by screwing screws (not shown in the drawings) into the screw holes 91, 92, 93, 94.

A series of rectangular openings 81, 83 are formed in the center frame 71. A slider 82 that can move along the long dimension of the opening 81 is fitted into the opening 81. A rack gear 63 that extends parallel to the long dimension of the opening 81 is provided on the slider 82. A slider 84 that can move along the long dimension of the opening 83 is fitted into the opening 83. A rack gear 64 that extends parallel to the long dimension of the opening 83 is provided on the slider 84. An approximately rectangular opening 74 is formed in the left side portion of the rear frame 72 (the right side portion in FIG. 5, which is a view from below). A finger grip support portion 67 that supports a fixed finger grip 66 can be moved within the opening 74.

Figure 6:
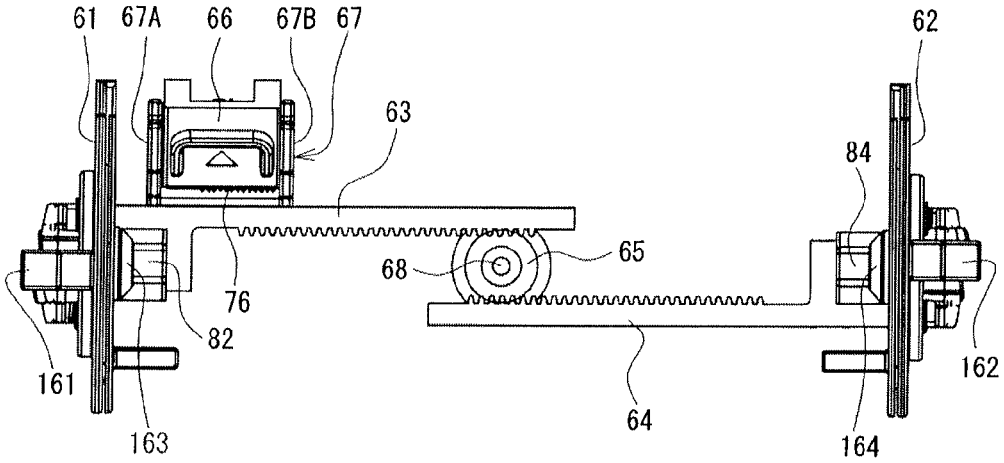
FIG. 6 is a plan view that shows the meshing of the pinion gear 65 and the rack gears 63, 64.

As shown in FIGS. 5 and 6, a pinion gear 65 that engages with the rack gear 63 and the rack gear 64 is affixed in the central portion of the center frame 71 by a screw 68 that allows it to rotate freely. As shown in FIG. 6, a supporting shaft 161 is provided on the slider 82 such that it extends in an orthogonal direction from the slider 82, and the supporting member 61, which is approximately in the shape of a circular plate and holds the left end of the paper roll 2, is supported by the supporting shaft 161 such that the supporting member 61 can rotate freely. A supporting shaft 162 is provided on the slider 84 such that it extends in an orthogonal direction from the slider 84. The supporting member 62, which has a generally circular plate shape and holds the right end of the paper roll 2, is supported by the supporting shaft 162 such that the supporting member 62 can rotate freely. A lug 163 in the shape of a truncated cone is provided in the center of the supporting member 61 and fits into a hole in the center of the left end of the paper roll 2. A lug 164 in the shape of a truncated cone is provided in the center of the supporting member 62 and fits into a hole in the center of the right end of the paper roll 2. The paper roll 2 is held such that it can rotate freely by the supporting member 61, the supporting member 62, the lug 163, and the lug 164.

As shown in FIGS. 5 and 6, the finger grip support portion 67, which supports the fixed finger grip 66 such that the finger grip 66 can be advanced and retracted, is connected to the rack gear 63 and the slider 82. The finger grip support portion 67 forms an approximately rectangular shape in a plan view and extends in a direction that is orthogonal to the long dimension of the rack gear 63. Walls 67A, 67B are respectively provided on the left and right edges of the finger grip support portion 67. The fixed finger grip 66 is supported between the wall 67A and the wall 67B of the finger grip support portion 67 such that the fixed finger grip 66 can be advanced and retracted in the direction that is orthogonal to the long dimension of the rack gear 63. As shown in FIG. 5, a spring 69 is contained in the rear face of the fixed finger grip 66, and the fixed finger grip 66 is urged toward the rack gear 63.

A series of comb-like teeth 76 are formed on the edge of the fixed finger grip 66 on the side toward the rack gear 63. A series of comb-like teeth 75 that engage with the comb-like teeth 76 of the fixed finger grip 66 are formed on the edge of the opening 74 on the side toward the rack gear 63. Therefore, when the comb-like teeth 76 of the fixed finger grip 66 engage with the comb-like teeth 75 of the opening 74, the rack gear 63 is locked in place and does not move. Therefore, the rack gear 64, which engages with the rack gear 63 through the pinion gear 65, also does not move. Therefore, the supporting members 61, 62 are locked in place and do not move with respect to the holder frame 70.

The paper roll 2 may have any one of various widths (lengths from one end of the cylinder to the other), depending on the width of the printing paper. It is therefore necessary to widen and narrow the interval between the supporting member 61 and the supporting member 62 according to the width of the paper roll 2 that is used. When the paper roll 2 with the widest printing width is used, the finger grip support portion 67, which supports the fixed finger grip 66, is positioned at the outer end of the holder frame 70, as shown in FIG. 5. In order to change from this state to using the paper roll 2 with the narrowest printing width, first, the fixed finger grip 66 is moved in the direction of an arrow that is provided on the fixed finger grip 66 (the direction that separates the fixed finger grip 66 from the rack gear 63), and the engagement of the comb-like teeth 76 of the fixed finger grip 66 with the comb-like teeth 75 of the opening 74 is released. This makes it possible to move the fixed finger grip 66 (the finger grip support portion 67) in the rightward direction in FIG. 6. When the fixed finger grip 66 is moved in the rightward direction in FIG. 6, the rack gear 63 moves to the right, and the rack gear 64, which is engaged with the rack gear 63 through the pinion gear 65, moves to the left, such that the interval between the supporting member 61 and the supporting member 62 becomes narrower. When the fixed finger grip 66 is released at the position that matches the width of the paper roll 2 that will be used, the comb-like teeth 76 of the fixed finger grip 66 and the comb-like teeth 75 of the opening 74 are engaged with one another by the urging force of the spring 69, and the rack gear 63 and the rack gear 64 are locked in place. The supporting member 61 and the supporting member 62 are thus locked in place. The paper roll 2 is therefore held by the supporting member 61 and the lug 163, and by the supporting member 62 and the lug 164.

Figure 7:
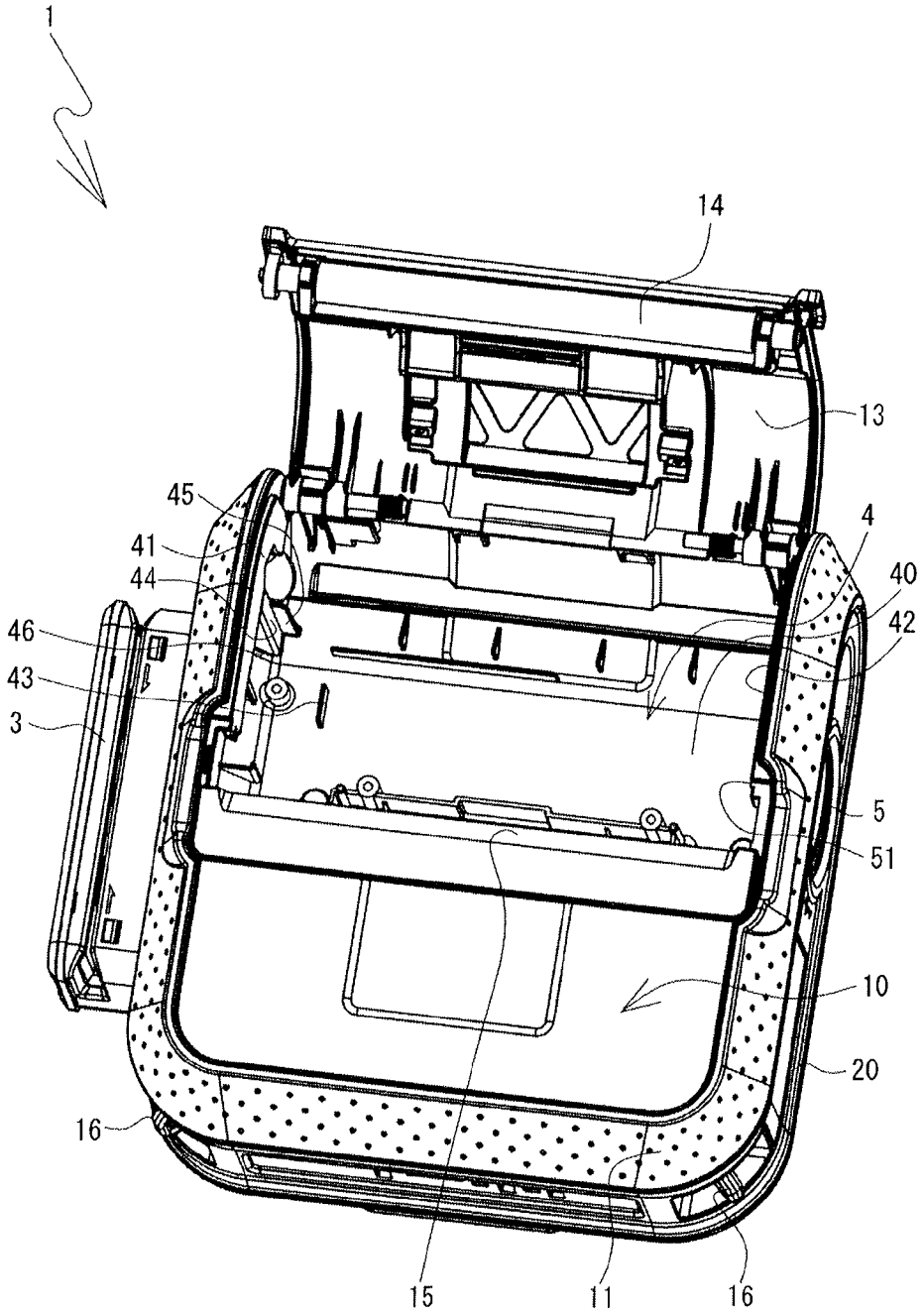
FIG. 7 is a perspective view of the printer 1 in a state in which the paper holder 6 has been removed.
Figure 9:
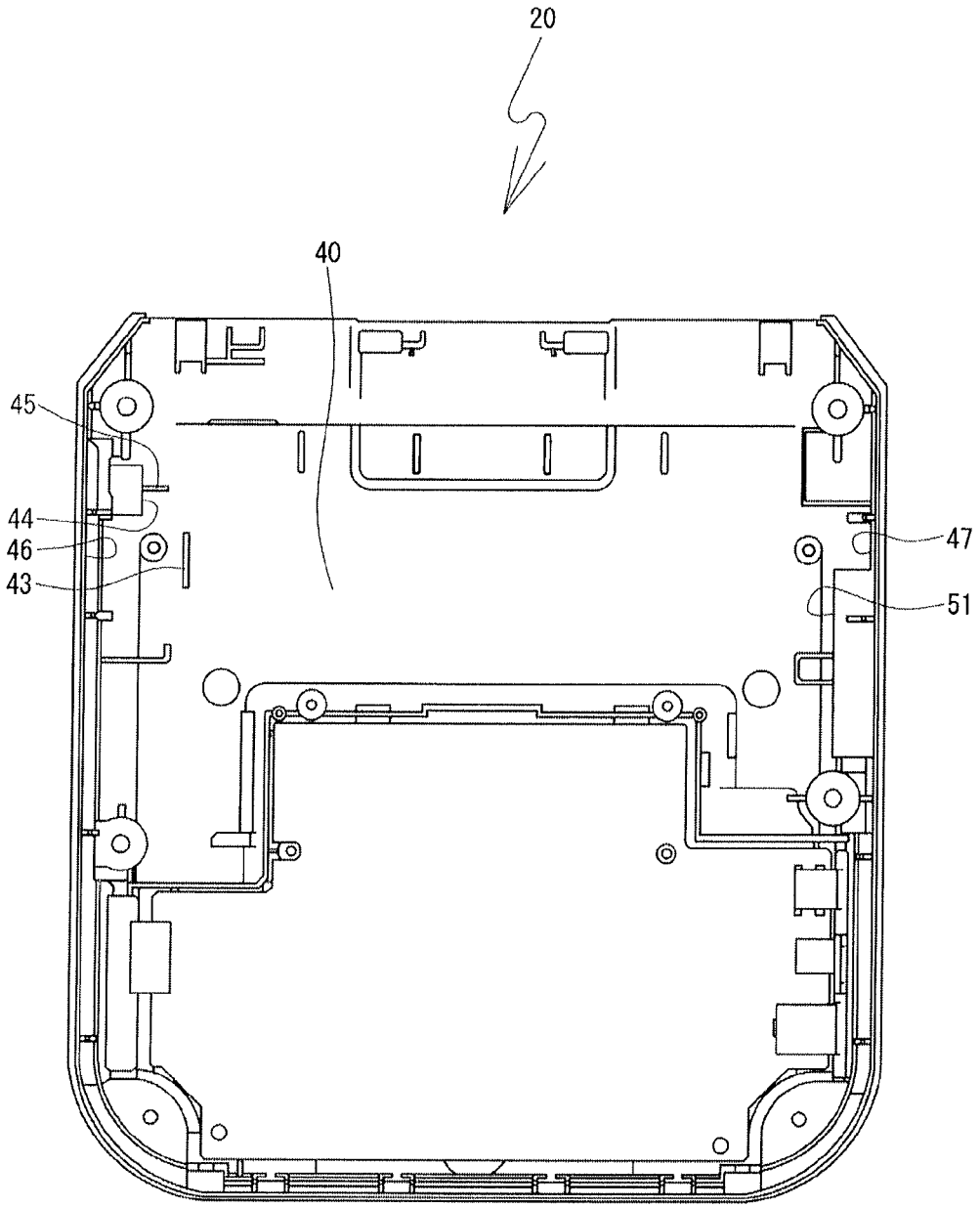
FIG. 9 is a plan view of a bottom case 20.

The internal configuration of the bottom case 20, in which the paper containing portion 4 is formed, will be explained with reference to FIGS. 7 and 9. When the paper holder 6 is contained in the paper containing portion 4, the paper holder 6 is secured in an orientation in which the rear frame 72 of the paper holder 6 (refer to FIG. 5) is positioned such that it faces a bottom face 40 of the bottom case 20. Therefore, the rear frame 72 is disposed at the bottom of the paper holder 6. A plate-shaped first projection 43 projects at a specified height from the bottom face 40 on side toward the card reader 3 (the left side in FIGS. 7 and 9). The faces of the first projection 43 are formed such that they extend in a direction that is orthogonal to the axial direction of the paper roll 2. When the paper holder 6 is contained in the paper containing portion 4, the first projection 43 is in contact with the finger grip support portion 67. A first inner wall surface 46 is provided at that left end of the paper containing portion 4 of the bottom case 20. An opening-closing member containing portion 51 that contains the opening-closing member 5 is provided such that it projects inward on a second inner wall surface 47 on the right end of the paper containing portion 4 (refer to FIG. 9). A rib 44 that has a specified width and a specified height and projects inward by a specified distance is provided on the first inner wall surface 46. A plate-shaped second projection 45 projects inward from the rib 44 by a specified distance that is parallel to the axial direction of the paper roll 2.

Figure 8:
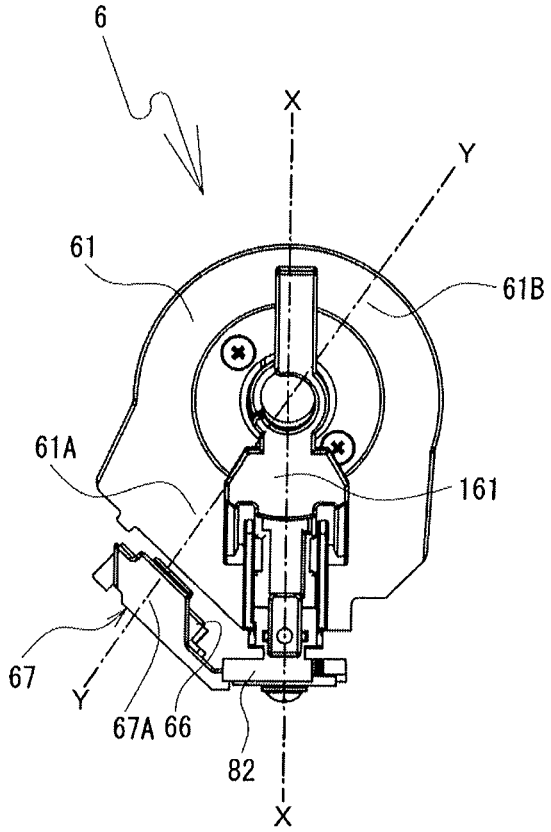
FIG. 8 is a left side view of the paper holder 6.

The relationships among the first projection 43, the second projection 45, the upper left inner wall surface 41, the wall 67A of the finger grip support portion 67 of the paper holder 6, and a first part 61A and a second part 61B of the supporting member 61 will be explained with reference to FIGS. 4, 7, and 8. As shown in FIG. 4, in a case where the paper roll 2 of the maximum width is used, the finger grip support portion 67 (the fixed finger grip 66) of the paper holder 6 is moved to the side of the paper holder 6 toward the card reader 3 (the leftmost side in FIG. 4). In this state, the first projection 43 (refer to FIG. 7) and the wall 67A of the finger grip support portion 67 of the paper holder 6 (refer to FIG. 8) face one another with a specified gap between them. The first part 61A of the supporting member 61 (refer to FIG. 8) and the second projection 45 (refer to FIG. 7) also face one another with a specified gap between them. The second part 61B of the supporting member 61 (refer to FIG. 8) and the upper left inner wall surface 41 (refer to FIG. 7) also face one another with a specified gap between them. The gap between the first projection 43 and the wall 67A of the finger grip support portion 67 of the paper holder 6 is defined as a gap L1. The gap between the first part 61A of the supporting member 61 and the second projection 45 is defined as a gap L2. The gap between the second part 61B of the supporting member 61 and the upper left inner wall surface 41 is defined as a gap L3. Here, the positional relationships among the first projection 43, the second projection 45, the upper left inner wall surface 41, the wall 67A of the finger grip support portion 67 of the paper holder 6, and the supporting member 61 are expressed by saying that the gap L1 is less than the gap L2, which is less than the gap L3.

An overview of the operation of the printer 1 that has the structure that is described above will be explained. During printing, the printing data are transmitted to the printer 1 from the external device, such as a PC terminal, a mobile telephone, or the like, by one of wireless, wired, and infrared communications. The printing paper is fed out from the paper roll 2, which is held by the paper holder 6, by the rotating of the platen roller 14 by the driving force of a motor that is not shown in the drawings. The printing paper that is fed out is guided to a portion where the platen roller 14 and the thermal head 7 make contact under pressure. The thermal head 7 performs printing on the printing paper of a desired pattern that is based on the printing data. After the printing, the printing paper is discharged from the discharge outlet 17 to the outside of the housing. Using the fixed edge 15, the operator manually cuts off the portion of the printing paper on which the printing has been completed, which has been discharged from the discharge outlet 17.

When the operator is carrying the printer 1 with the structure that is described above, cases occur in which the operator drops the printer 1 or strikes it against a fixed object. A case in which the printer 1 is dropped on the ground or the like with the side where the card reader 3 is located facing downward and a case in which the side of the printer 1 where the card reader 3 is located is struck against a fixed object will be explained. In these cases, because the paper roll 2 is heavy, an impact is applied in the direction from the first projection 43 toward the finger grip support portion 67, and an inertial force operates from the paper roll 2 toward the supporting member 61. At this time, in a case where the paper roll 2 of the maximum width is mounted in the paper holder 6, the relationships among the gap L1, the gap L2, and the gap L3 are such that the gap L1 is less than the gap L2, which is less than the gap L3.

Therefore, when the printer 1 receives the impact, first, the wall 67A of the finger grip support portion 67 of the paper holder 6 comes into contact with the first projection 43 of the bottom case 20. Next, the first part 61A of the supporting member 61 comes into contact with the second projection 45, and finally, the second part 61B of the supporting member 61 comes into contact with the upper left inner wall surface 41. Therefore, first, the impact is partially absorbed by the elasticity of the finger grip support portion 67, which is provided with sufficient width and strength. Next, the elasticity of the supporting member 61 gives rise to twisting in the supporting member 61, and the second part 61B comes close to the upper left inner wall surface 41, but the second projection 45 comes into contact with the first part 61A of the supporting member 61 first, such that the supporting member 61 is supported. Last, the second part 61B comes into contact with the upper left inner wall surface 41. Therefore, because the portions of the paper holder 6 that make contact, along a line Y-Y that is shown in FIG. 8, are the finger grip support portion 67, the first part 61A, and the second part 61B, in that order, it is possible to prevent a large impact from being applied to the supporting member 61 all at once. That means that damage to the paper holder 6 can be prevented. It is also possible to prevent slippage from occurring in the engaging of the rack gears 63, 64 with the pinion gear 65, so that a phase discrepancy can be prevented. It is also possible to prevent the supporting member 61 from being damaged and to prevent damage to the supporting shaft 161 along a line X-X. Furthermore, because the wall 67A is formed to be thicker than the supporting member 61, the wall 67A has sufficient strength not to be damaged. In addition, the finger grip support portion 67 of the fixed finger grip 66 that engages with the rack gear 63 moderates the impact by bending, so slippage in the engaging of the rack gear 63 and the pinion gear 65 can be prevented.

A case in which the printer 1 is dropped on the ground or the like with the side where the opening-closing member 5 is located facing downward and a case in which the side of the printer 1 where the opening-closing member 5 is located is struck against a fixed object will be explained. In these cases, the supporting member 62 comes into contact with and is supported by the opening-closing member containing portion 51 that projects from the second inner wall surface 47, as shown in FIG. 9. In above-described embodiment, the wall 67A of the finger grip support portion 67 is one example of the contacting portion.

Various types of modifications can be made to the present disclosure. For example, a projecting portion may be provided on the bottom face of the rear frame 72 of the paper holder 6, such that the portion that comes into contact with the first projection 43 of the bottom case 20 is not the wall 67A of the finger grip support portion 67, but the projecting portion on the bottom face of the rear frame 72. Furthermore, the first projection 43 and the second projection 45 are not limited to being plate-shaped, and various types of shapes can be adopted, such as a boss shape, a square columnar shape, and the like, as long as the shape is a projection.

What is claimed is:

1. A printer, comprising:

a first case and a second case that configure a housing;

a paper containing portion that is formed in the first case and is configured to contain a paper roll around which a printing paper is wound;

a paper holder that is provided in the paper containing portion and is configured to hold the paper roll;

a pair of supporting members that are provided in the paper holder and are configured to hold both ends of the paper roll, with each of the supporting members holding one of the ends;

a contacting portion that is provided in the paper holder and is thicker in the axial direction of the paper roll than are the supporting members; and a first projection that projects in the paper containing portion from the first case toward the paper holder;

is positioned, in the axial direction of the paper roll, which is orthogonal to the direction in which the printing paper is pulled off of the paper roll, between the contacting portion and a wall surface of the first case that is located on the side of the contact portion, and is able to come into contact with the contacting portion when an impact is applied in the direction from the first projection toward the contacting portion and the contacting portion moves parallel to the axial direction, the first projection having a base end disposed on the first case, a leading end enclosed in the paper containing portion, and faces that extend in a direction that is orthogonal to the axial direction of the paper roll a rib that is formed on a first inner wall surface facing the first projection, in the direction that is orthogonal to the direction in which the printing paper is pulled off of the paper roll in the paper containing portion, the rib having a specified width and a specified height and projecting from the first inner wall surface toward the contacting portion by a specified distance, a second projection that is formed on the rib and projects from the rib, wherein the second projection and the supporting member that is located on the side of the paper holder toward the first inner wall surface are configured to be able to come into contact with one another, and a first gap between the first projection and the contacting portion is configured to be narrower than a second gap between the second projection and the supporting member that is located on the side of the paper holder toward the first inner wall surface.

2. The printer according to claim 1, wherein when an impact is applied in the direction from the first projection toward the contacting portion, the contact between the first projection and the contacting portion occurs earlier than the contact between the second projection and the supporting member that is located on the side from which the impact is applied.

3. The printer according to claim 1, wherein second case inner wall surfaces are formed in the paper containing portion, one on each side in the direction that is orthogonal to the direction in which the printing paper is pulled off of the paper roll, the second case inner wall surfaces and the supporting members are configured such that the supporting member that is located on each side in the direction that is orthogonal to the direction in which the printing paper is pulled off of the paper roll is able to come into contact with the second case inner wall surface on the same side, and a third gap between the supporting member that is located on each side in the direction that is orthogonal to the direction in which the printing paper is pulled off of the paper roll and the second case inner wall surface on the same side is configured to be wider than the second gap between the second projection and the supporting member that is located on the side of the paper holder toward the first inner wall surface.

4. The printer according to claim 3, wherein the contact between the supporting member and the second case inner wall surface that are located on the side from which an impact is applied in the direction from the first projection toward the contacting portion occurs later than the contact between the second projection and the supporting member that is located on the side from which the impact is applied, when the impact is applied.

5. The printer according to claim 3, further comprising:

a lid that covers the paper containing portion;

an opening-closing member that opens and closes the lid; and an opening-closing member containing portion that contains the opening-closing member, wherein the opening-closing member containing portion is formed in the paper containing portion on a second inner wall surface that faces the first inner wall surface, the opening-closing member containing portion projecting interiorly of said housing.

6. The printer according to claim 5, wherein the supporting member that is located on the side from which an impact is applied from the direction of the opening-closing member containing portion comes into contact with a wall of the opening-closing member containing portion when the impact is applied.

7. The printer according to claim 1, further comprising:

a lid that covers the paper containing portion;

an opening-closing member that opens and closes the lid; and an opening-closing member containing portion that contains the opening-closing member, wherein the opening-closing member containing portion is formed in the paper containing portion on a second inner wall surface that faces the first inner wall surface, the opening-closing member containing portion projecting interiorly of said housing.

8. The printer according to claim 7, wherein the supporting member that is located on the side from which an impact is applied from the direction of the opening-closing member containing portion comes into contact with a wall of the opening-closing member containing portion when the impact is applied.

9. The printer according to claim 1, wherein the contacting portion is a support portion for a locking grip that locks movement of the supporting members.

10. The printer according to claim 9, wherein the paper holder is provided, on the side that faces the first case, with a pair of rack gears that are parallel to one another and that engage with a single pinion gear, each of the rack gears is affixed to one of the supporting members, and the support portion for the locking grip is provided on one of the rack gears such that it extends in a direction opposite from the pinion gear.

11. A printer, comprising:

a first case and a second case that configure a housing;

a paper containing portion that is formed in the first case and is configured to contain a paper roll around which a printing paper is wound;

a paper holder that is provided in the paper containing portion and is configured to hold the paper roll;

a pair of supporting members that are provided in the paper holder and are configured to hold both ends of the paper roll, with each of the supporting members holding one of the ends;

a contacting portion that is provided in the paper holder and is thicker in the axial direction of the paper roll than are the supporting members; and a first projection that projects in the paper containing portion from the first case toward the paper holder;

is positioned, in the axial direction of the paper roll, which is orthogonal to the direction in which the printing paper is pulled off of the paper roll, between the contacting portion and a wall surface of the first case that is located on the side of the contact portion, and is able to come into contact with the contacting portion when an impact is applied in the direction from the first projection toward the contacting portion and the contacting portion moves parallel to the axial direction, the first projection having a base end disposed on the first case, a leading end enclosed in the paper containing portion, and faces that extend in a direction that is orthogonal to the axial direction of the paper roll;

a rib that is formed on a first inner wall surface that is located on the same side of the first projection, in the direction that is orthogonal to the direction in which the printing paper is pulled off of the paper roll in the paper containing portion, the rib having a specified width and a specified height and projecting from the first inner wall surface toward the contacting portion by a specified distance; and a second projection is formed on the rib and projects from the rib, wherein second case inner wall surfaces are formed in the paper containing portion, one on each side in the direction that is orthogonal to the direction in which the printing paper is pulled off of the paper roll, the second projection and the supporting member that is located on the side of the paper holder toward the first inner wall surface are configured to be able to come into contact with one another, the second case inner wall surfaces and the supporting members are configured such that the supporting member that is located on each side in the direction that is orthogonal to the direction in which the printing paper is pulled off of the paper roll is able to come into contact with the second case inner wall surface on the same side, and a third gap between the supporting member that is located on each side in the direction that is orthogonal to the direction in which the printing paper is pulled off of the paper roll and the second case inner wall surface on the same side is configured to be wider than a second gap between the second projection and the supporting member that is located on the side of the paper holder toward the first inner wall surface.

12. The printer according to claim 11, wherein the contact between the supporting member and the second case inner wall surface that are located on the side from which an impact is applied in the direction from the first projection toward the contacting portion occurs later than the contact between the second projection and the supporting member that is located on the side from which the impact is applied, when the impact is applied.

* * * * *